US010221666B2

(12) United States Patent
Blendinger et al.

(10) Patent No.: US 10,221,666 B2
(45) Date of Patent: Mar. 5, 2019

(54) METHOD FOR INTRODUCING AN INDUCTOR LOOP INTO A ROCK FORMATION

(71) Applicant: Siemens Aktiengesellschaft, Munich (DE)

(72) Inventors: Stefan Blendinger, Fuerth (DE); Vladimir Danov, Erlangen (DE); Dirk Diehl, Bubenreuth (DE); Andreas Koch, Neunkirchen am Brand (DE)

(73) Assignee: Siemens Aktiengesellschaft, Munich (DE)

( * ) Notice: Subject to any disclaimer, the term of this patent is extended or adjusted under 35 U.S.C. 154(b) by 213 days.

(21) Appl. No.: 15/100,832

(22) PCT Filed: Sep. 2, 2014

(86) PCT No.: PCT/EP2014/068613

§ 371 (c)(1),
(2) Date: Jun. 1, 2016

(87) PCT Pub. No.: WO2015/090646

PCT Pub. Date: Jun. 25, 2015

(65) Prior Publication Data

US 2017/0306736 A1 Oct. 26, 2017

(30) Foreign Application Priority Data

Dec. 18, 2013 (EP) ..... 13198019

(51) Int. Cl.

| | |
|---|---|
| ***E21B 43/24*** | (2006.01) |
| ***E21B 43/30*** | (2006.01) |
| *E21B 7/04* | (2006.01) |

(52) U.S. Cl.
CPC ..... *E21B 43/2401* (2013.01); *E21B 43/30* (2013.01); *E21B 43/305* (2013.01); *E21B 7/04* (2013.01)

(58) Field of Classification Search
CPC ..... E21B 7/04; E21B 43/2401; E21B 43/305
See application file for complete search history.

(56) References Cited

U.S. PATENT DOCUMENTS 4,116,273 A * 9/1978 Fisher ..... E21B 43/2401 166/248
8,813,835 B2 8/2014 Diehl
(Continued)

FOREIGN PATENT DOCUMENTS

DE 10 2004 009896 9/2005
DE 10 2008 044955 3/2010
(Continued)

*Primary Examiner* — Matthew R Buck
(74) *Attorney, Agent, or Firm* — Cozen O'Connor

(57) ABSTRACT

An induction device and method for introducing an inductor loop into a rock formation to heating an oil reservoir in the rock formation to extract oil extraction, wherein a first inductor bore is chilled for introducing a first inductor arm, a second inductor bore is drilled for introducing a second inductor arm, at least one intersecting bore is drilled to create a first area of intersection with the first inductor bore and a second area of intersection with the second inductor bore, the first inductor arm is introduced into the first inductor bore and the second inductor arm is introduced into the second inductor bore, and at least one connecting arm is introduced into the intersecting bore for electrically conductive connection to the two inductor arms in the two areas of intersection so as to form the inductor loop.

12 Claims, 7 Drawing Sheets

(56) References Cited

U.S. PATENT DOCUMENTS

| | | | | |
|---|---|---|---|---|
| 8,887,810 | B2 * | 11/2014 | Parsche | E21B 43/2401 166/248 |
| 9,574,430 | B2 * | 2/2017 | Diehl | E21B 43/2401 |
| 2010/0252249 | A1 * | 10/2010 | Diehl | E21B 43/2401 166/60 |
| 2011/0006055 | A1 * | 1/2011 | Diehl | E21B 36/04 219/600 |
| 2011/0042063 | A1 | 2/2011 | Diehl et al. | |
| 2011/0042085 | A1 | 2/2011 | Diehl et al. | |
| 2011/0108273 | A1 | 5/2011 | Huber et al. | |
| 2011/0146968 | A1 * | 6/2011 | Diehl | E21B 43/2401 166/60 |
| 2011/0146981 | A1 | 6/2011 | Diehl | |

FOREIGN PATENT DOCUMENTS

| | | | | |
|---|---|---|---|---|
| DE | 10 2010 043302 | | 3/2012 | |
| RU | 2010954 | C1 | 4/1994 | |
| RU | 2465441 | C2 | 10/2012 | |
| WO | WO 2009/027262 | | 3/2009 | |
| WO | WO 2009/027305 | | 3/2009 | |
| WO | WO-2011101227 | A2 * | 8/2011 | E21B 43/2401 |
| WO | WO 2011/127292 | | 10/2011 | |

* cited by examiner

METHOD FOR INTRODUCING AN INDUCTOR LOOP INTO A ROCK FORMATION

CROSS-REFERENCE TO RELATED APPLICATIONS

This is a U.S. national stage of application No. PCT/EP2014/068613 filed 2 Sep. 2014. Priority is claimed on European Application No. 13198019.5 filed 18 Dec. 2013, the content of which is incorporated herein by reference in its entirety.

BACKGROUND OF THE INVENTION

1. Field of the Invention

The present invention relates to an induction device and a method for introducing an inductor loop into a rock formation to heat an oil reservoir.

2. Description of the Related Art

It is known that new methods will be used for extraction from heavy oil deposits. In this case, oil reservoirs are present in rock formations in which the oil is bound with sand, for example. In order to allow the extraction of oil that is bound in this manner, the oil must be heated to achieve a lower viscosity. Only in this way is it possible to pump oil from such an oil reservoir in a fluid manner. In order to achieve the heating, various techniques are known. For example, it is possible to use the steam injection method, which by introducing hot steam into the oil reservoir it is possible to heat the reservoir and thereby reduce the viscosity of the oil that is to be extracted. It is also known that inductor cables can be introduced, generating electromagnetic eddy currents in the oil reservoir and thereby causing the oil reservoir to heat up.

Use of the hot steam method is disadvantageous in that it is difficult or impossible to predetermine the heat distribution within the oil reservoir. With regard to the known induction heating for the oil reservoir, the introduction of the inductor cables is particularly difficult. For purposes of induction heating, it is thus essential to form a so-called inductor loop. In other words, an annular or otherwise closed form of the inductor cable must be introduced into the oil reservoir. For example, this is done using flat bores in the region of approximately 40 m below the surface of the rock formation. The so-called banana loop method can be used in this case, where two essentially parallel bores are made along a curved path. Each of these bores has an entry opening and an exit opening, such that the two exit openings at the surface of the rock formation can be used to connect the two ends of the two inductor arms back together at the surface and thereby form the inductor loop. However, such a method can only be used for the oil reservoir in regions that are close to the surface. Such a drilling method is not possible in the case of deep bores in regions of up to 800 m or 1000 m below the surface of the rock formation. In particular, this is because the force of the weight of the boring rod itself has a contributory effect when drilling a bore. If it was then necessary, such as in the case of the banana loop method, to drill this distance back upwards from a depth of approximately 1000 m, the relevant boring rod would no longer act in unison with the drilling pressure on the drill head, but would instead relieve the pressure on it. Any corresponding advance would therefore be extremely difficult to achieve, and the expense of such a deep banana loop bore would be unthinkably high in terms of cost, time and complexity. Therefore, it is not currently possible to use inductor loops for the purpose of heating in oil reservoirs located in deeper regions of rock formations.

DE 10 2008 044 955 A1 discloses an exemplary induction heating apparatus for reducing the viscosity of bitumen or extra heavy oil is already known. To form an induction loop, at least two linearly extended conductors are guided in the horizontal direction at a predefined depth of the reservoir and are electrically connected at their ends. The electrical connection can be disposed above or below ground.

WO 2011/127292 A1 discloses a method for heating rock formations in which a heating device, which can be formed as an electrical resistance heater, for example, is introduced into bores, which can be formed as main bores and bores branching laterally from the main bores.

DE 10 2010 043 302 A1 describes an induction heating device for oil sand deposits in which particular measures are taken to reduce the ingress of heat into the local vicinity of the conductor.

A method is known from WO 2009/027262 A1 for extracting bitumen or extra heavy oil from oil sand deposits close to the surface, in which a predefined geometry with the arrangement of heating elements and an extraction pipe is maintained.

SUMMARY OF THE INVENTION

It is an object of the present invention to provide an induction device and method for making induction heating feasible in an economical and simple manner, even for deep bores, in a manner that at least partly overcomes the above-described disadvantages.

This and other objects and advantages are achieved in accordance with the invention by a method and an induction device having in which the method in accordance with the invention is used to introduce an inductor loop into a rock formation to heat an oil reservoir in the rock formation for the purpose of oil extraction. To this end, the method comprises the following steps of drilling a first inductor bore for introducing a first inductor arm, drilling a second inductor bore for introducing a second inductor arm, drilling at least one intersecting bore to create a first region of intersection with the first inductor bore and a second region of intersection with the second inductor bore, introducing the first inductor arm into the first inductor bore and the second inductor arm into the second inductor bore, and introducing at least one connecting arm into the intersecting bore for electrically conductive connection to the two inductor arms in the two regions of intersection so as to form the inductor loop.

In accordance with the invention, a total of three bores are now made. One inductor bore is made for each of the first inductor arm and the second inductor arm. It should be understood that is also possible to use three or more inductor arms in the case of more complex geometries of the oil reservoir. It is crucial in this case that, in accordance with the invention, a dedicated inductor bore is created for each inductor arm. It is, however, possible for the inductor bores to overlap each other sectionally. In other words, it may be the case that all of the inductor bores are created by a shared inductor bore opening, such that all or some of the inductor bores run together in the initial region of the respective bore. At the latest within the oil reservoir, however, the individual inductor bores diverge and extend in particular parallel to each other, in order to span an area in which the inductively generated eddy currents can effect the heating of the oil reservoir.

In addition to the inductor bores that are required for introducing the inductor arms, provision is inventively made for at least one intersecting bore. This intersecting bore is then used to meet or approximately meet the ends of the inductor bores, these having the form of blind holes. This means that the intersecting bore is drilled so as to arrive as close as possible to the ends of the individual inductor bores. For this purpose, a locating means in particular can be used in addition to conventional drilling mechanisms, so that the respective ends of the inductor arms can also be detected during the drilling.

The operation of the present invention is dependent on a region of intersection being created between the intersecting bore and the respective inductor bore. Within the meaning of the present invention, a region of intersection is understood to be a region that essentially extends between the at least two inductor bore ends or distal ends of the inductor arms that have been introduced. Advantageously, the inductor arms that have been introduced into the rock formation terminate within the region of intersection. The region of intersection is advantageously only a small section of the oil reservoir that must be warmed, where the region of intersection could also lie outside of the oil reservoir that is to be warmed or heated. The region of intersection is preferably smaller than or equal to approximately 1 m. This means that, in this region of intersection, the separating distance between the intersecting bore and the inductor bore, preferably the end of the inductor bore, is configured such that it is less than or equal to approximately 1 m. Indeed, an actual crossover or overlap between the intersecting bore and the respective inductor arm is preferred. In order for the inductor loop to be electrically closed by the connecting arm, it is nevertheless sufficient for the region of intersection to have a size of less than approximately 1 m as described above.

Once the bores described above for the inductor arms and the connecting arm in the form of the intersecting bore have been made, the introduction of the individual arms can take place. The intersecting bore itself can, for example, be configured in the form of a circular bore or also in the form of a horizontal bore. It is consequently possible for a plurality of inductor bores that extend in parallel and horizontally, at least sectionally, to be advantageously connected via a single intersecting bore that extends vertically, at least sectionally. Moreover, it is consequently possible for a plurality of inductor bores that largely extend radially and horizontally, to be connected by a single intersecting bore that is configured in the form of a circular bore. The inductor arms are inserted via the inductor bores. They are now located within the oil reservoir at their furthest extremes, and extend to the corresponding control unit on the surface of the rock formation. One or more connecting arms are now inserted into the intersecting bore. For example, one connecting arm is required for two inductor arms, and two connecting arms are required for four inductor arms, etc. The connecting arms do not extend over the entire length of the intersecting bore, but only extend over subsections of the intersecting bore. The connecting arms therefore have a length that corresponds to the length of the intersecting bore between the two corresponding or correlating regions of intersection containing the two inductor arms. Therefore, at least one connecting arm advantageously extends between two inductor arms to create an inductor loop. The introduction is effected such that an electrically conductive connection is made between the respective ends or at other points of the inductor arms in the respective inductor bores. This can occur in a mechanically contacting manner, for example. It is therefore possible to introduce devices which, in the case of an actual overlap of the intersecting bore and the respective inductor bore in the region of intersection, allow a mechanical contact to be made for the electrically conductive connection between the connecting arm and the end of the respective inductor arm. It is advantageous here that both above-ground connection of the inductor arms and below-ground direct coupling of the inductor arms as disclosed generally in the prior art are no longer required.

It is, however, also sufficient in principle to rely on an existing electrical conductivity, even if only slight, of the rock formation or of the oil reservoir in the region of intersection. This means that the inductor loop is formed by the inductor arms, the connecting arm and the region of intersection in the form of the rock formation and the rock that is present there.

Depending on the rock, it is however possible that the electrical conductivity might not be adequate. In the event that no actual overlap occurs between the intersecting bore and inductor arm, it is possible to deliberately increase the conductivity of the region of intersection. This can be effected by using an electrically conductive fluid or medium, for example. In this case, the fluid can be introduced into the region of the intersecting bore and spread out within the intersecting bore so as to create a connection between the first region of intersection and the second region of intersection and, consequently, the first inductor arm and the second inductor arm. Introduction of a connecting arm into the intersecting bore is advantageously replaced by introduction of an electrically conductive fluid in order to form an inductor loop. It is, however, also conceivable to introduce the electrically conductive fluid in addition to the connecting arm, at least into the region of intersection within the intersecting bore, in order to advantageously allow a connection between the first inductor arm, the second inductor arm and the connecting arm to form an inductor loop. This advantageously prevents or rectifies a possibly unsatisfactory contact of the connecting arm with one of the inductor arms. Further detailed possibilities for introducing or using the electrically conductive fluid are explained in greater detail below.

In accordance with the invention, a simple bore can now be used for each inductor bore and the intersecting bore. Crucially in this case, all of these bores are aligned exclusively downwards (i.e., in a vertical direction) or horizontally within the oil reservoir. Unlike the conventional banana loop method, upward drilling is no longer required, and it is therefore possible to use drilling techniques that are simple, economical and above all achievable in a relatively short time. This means that by virtue of the method in accordance with the invention, the possibility of induction heating of the oil reservoir is now also available for the first time at any depth within the rock formation. In particular, oil reservoirs that are located even in deep drilling regions at approximately 1000 m or more below the surface of the rock formation can be provided with induction heating by the inductor loop.

In an advantageous embodiment of the method in accordance with the invention, the first inductor bore and the second inductor bore are drilled through a shared inductor bore opening. As suggested previously, it is sufficient for the individual inductor bores to extend separately from each other within the oil reservoir. They therefore span the induction field or the heating field in the oil reservoir. The creation of a shared inductor bore opening, such that the inductor bores then extend together along a shared inductor bore axis at this inductor bore opening, results in a reduction of the drilling expense. The inductor bores preferably have an enlarged bore cross section over their shared sections, thereby allowing them to accommodate the total number of all the inductor arms to be passed through this shared inductor bore. It is also advantageous that this embodiment results in minimal heat output within the vertical bore direction of the inductor bores. The heat output is dependent on the separating distance between the individual inductor arms. The greater the separating distance between the inductor arms, the greater the heat output. If the inductor arms are as close to each other as possible in their vertical sections, e.g., extending in a shared vertical inductor bore, this results in a low or very low heat output into these sections. Only after splitting into the individual separate inductor bores do the inductor arms have a separating distance between them, such that the heat output is then provided primarily and precisely at the desired location within the oil reservoir. The branching that occurs for the separation of the individual inductor bores from each other can occur at different depths within the rock formation, for example. A separation of the individual inductor bores from each other at different positions at a shared depth or even in different radial directions is also conceivable.

In another advantageous embodiment of the method in accordance with the invention, the inductor bores have at least one redirection point, in particular exactly one redirection point. In other words, the inductor bores are largely formed of a vertical and an essentially horizontal or oblique section. The vertical sections ensure that the inductor arms can be introduced as vertically as possible into the rock formation. Vertical bores are particularly economical, quick and easy to implement. The use of at least one redirection point means that a horizontal or angled section can now be provided for the respective inductor bore. These horizontal or angled sections of the inductor bores now preferably extend into the oil reservoir. The actual orientation of the respective redirection point preferably depends on the respective geometric formation of the oil reservoir within the rock formation. In this case, the redirection is preferably configured so as to effect a redirection into the horizontal or downwards from the horizontal at an angle. This avoids the need to drill upwards and the disadvantages described above.

In a further advantageous embodiment of the method in accordance with the invention, the intersecting bore has at least one redirection point, in particular it is drilled sectionally along a curved path. A redirection point for the intersecting bore has the same advantages as those described above in relation to the redirection point for the inductor bores. A curved path, i.e., a continuous redirection point that is preferably in an angled or horizontal plane, makes it possible to create a network of inductor arms or inductor bores that is radially distributed in the form of a star, using a single intersecting bore. It is thereby possible in an inventive manner to achieve particularly homogenous heating of an oil reservoir that is essentially radial using only a modest number of bores.

In yet another advantageous embodiment of the method in accordance with the invention, a locating means is arranged at the bore end of at least one of the inductor bores, for the purpose of detecting this bore end when drilling the intersecting bore. Such a locating means can then emit radiation in the form of radioactive radiation or electromagnetic radiation, for example. An acoustic signaling means, such as in the form of ultrasound, can also be provided for the locating means. A magnetic embodiment of the locating means is also conceivable. It is crucial that the type of signal emitted by the locating means can be transported through the rock. It is thus possible when drilling the intersecting bore, e.g., using a detection device, to be aware of the actual location of the respective locating means. The control or the orientation of the drill head for the intersecting bore can then be directed at this bore end, thereby increasing the probability of meeting the region of intersection. In particular, it is thereby possible with a high degree of probability to achieve an actual overlap between the intersecting bore and the respective inductor arm.

In a further advantageous embodiment, the intersecting bore adjacent to the at least one connecting arm is closed off, in particular filled-in. This is preferably done if parts of the region of intersection are supplied with electrically conductive liquids or fluids. As a result of closing off and therefore sealing the connecting arm, it is ensured that such electrically conductive fluid also remains at the desired location in the region of intersection. As a result of this closing off and infilling, e.g., using concrete material, it is moreover possible to fix the position of the connecting arm within the intersecting bore for a longer time. Any unwanted movement or slippage, which could possibly cause the loss of the electrically conductive connection to the inductor arm, is thus prevented.

In another advantageous embodiment, the inductor bores within the oil reservoir are drilled at uniform or essentially uniform separating distances of more than approximately 50 m in particular. This relates in particular to the horizontal or angled sections of the inductor bores within the oil. A separating distance that is so configured so as to be uniform results in uniform heat output within the oil reservoir. In this way, undesired islands of heat in partial regions of the oil reservoir are avoided. Separating distances of approximately 50 m and more result in a particularly advantageous and strong heat output, allowing a sufficient reduction in the viscosity of the oil in the oil reservoir.

In yet a further advantageous embodiment of the method in accordance with the invention, an electrically conductive fluid is introduced into at least one of the regions of intersection, in order to create the electrically conductive connection of the connecting arm and the adjacent inductor arm. As explained above, only sufficient proximity between intersecting bore and respective inductor bore is required in the regions of intersection. In this case, the regions of intersection preferably have a separating distance of less than or equal to approximately 1 m between the intersecting bore and the respective inductor bore. If the rock formation then contains a rock that has a high electrical resistance or a low electrical conductivity, this can be improved by introducing an electrically conductive fluid into this region of intersection. This introduction is effected, e.g., via pressure, which forces the fluid into the region of intersection. For example, an aqueous or liquid suspension of electrically conductive particles can be used as an electrically conductive fluid. The solid powder in such a suspension can be graphite, chromium oxide or a similar material, for example. Ionic liquids or saline solutions can also be used as electrically conductive fluids. In particular, the electrically conductive fluid is an electrically conductive liquid. In summary, the region of intersection with the electrically conductive fluid therefore also becomes part of the induction device, because it forms a part of the inductor loop in the electrical chain between inductor arm, electrically conductive fluid, connecting arm, electrically conductive fluid and the second inductor arm.

The disclosed embodiment of the method as described in the previous paragraph can be developed by introducing at least one transverse bore into the regions of intersection of the intersecting bore, for the purpose of introducing the electrically conductive fluid. In order to allow the electrically conductive fluid to be distributed even more appropriately, bores can be made transversely, in particular perpendicularly to the bore axis of the intersecting bore, in order to provide an opening into the region of intersection. It is preferably even possible to provide a complete transverse bore forming an overlap and, hence, a passage between the intersecting bore and adjacent inductor bore. This region is filled with the electrically conductive fluid or the surrounding rock is saturated with the electrically conductive fluid. The previously described electrically conductive connection between connecting arm and inductor arm is thereby established.

It is also an object of the invention to provide an induction device for heating an oil reservoir in a rock formation for the purpose of oil extraction. This induction device is developed via a method in accordance with disclosed embodiments of the invention in particular, and has a first inductor arm in a first inductor bore and a second inductor arm in a second inductor bore. The induction device in accordance with the invention is configured such that at least one connecting arm is arranged in an intersecting bore which forms regions of intersection with the two inductor bores. In this case, the connecting arm connects the two inductor arms together in an electrically conductive manner. As a result of developing the induction device in accordance with the disclosed embodiments of the invention, in particular using a method in accordance with disclosed embodiments of the invention, the induction device in accordance with the invention has the same advantages as those explained in detail with reference to a method in accordance with disclosed embodiments of the invention.

When using a method in accordance with disclosed embodiments of the invention, provision is preferably made for a frequency generator that feeds the inductor loop with a frequency between 1 kHz and 500 kHz.

The inductor loop in the form of an electrical conductor in particular can be configured as an induction line so that it is able to carry the high-frequency current, operating as a resonant circuit with low losses. Both ends are preferably connected to the frequency generator. As a result, the induction line forms an inductor loop. The technical realization of the electrical line takes the form of a resonant circuit.

The frequency generator may comprise a frequency converter that converts a voltage having a frequency of 50 Hz or 60 Hz from the electricity network into a voltage having a frequency in the range of 1 kHz to 500 kHz. The frequency converter can be installed above ground.

At least one extraction bore can also be drilled, preferably into the deposit zone that has been warmed by the inductor loop, i.e., the oil reservoir.

After installation of the inductor loop in at least two bores and connection of the inductor loop to the frequency generator, the injection of current into the conductor begins, causing the inductive warming of substrate and oil reservoir, and resulting development of a warming zone characterized by an increased temperature.

A conductor of an inductor loop may have a series inductance per unit length of 1.0 to 2.7 μH/m (microhenry per meter length). The transverse capacitance per unit length is e.g. 10 to 100 μF/m (picofarad per meter length). The characteristic frequency of the arrangement is determined by the loop length and shape, and by the transverse capacitance per unit length along the inductor loop. During operation, the inductor loop acts as an induction heater to introduce additional warmth into the deposit. The active region of the inductor loop can describe an almost closed loop (i.e., an oval) in an essentially horizontal direction within the deposit. An end region, possibly situated above ground, can connect to the active region. Those parts of the start and end region of the inductor loop that are situated above ground can be electrically attached to a current source, specifically a frequency generator. Provision is preferably made to compensate for the line inductance of the inductor loop sectionally by series capacitors that are configured to be discrete or continuous. For the inductor loop with integrated compensation, provision can be made for the frequency of the frequency generator to be tuned to the resonant frequency of the inductor loop in this case. The capacitance in the inductor loop can be provided by cylinder capacitors between a tubular outer electrode of a first cable section and a tubular inner electrode of a second cable section, between which is situated a dielectric. The adjacent capacitor is formed between the following cable sections correspondingly. Here, dielectric of the capacitor is selected so as to have a high dielectric strength and high temperature stability.

It is also conceivable to provide a plurality of coaxial electrodes that are nested one inside the other. Other standard capacitor design formats can also be integrated into the line of the inductor loop.

It is also possible for the entire electrode to already be enclosed by an insulation. The insulation against the surrounding earth is advantageous in order to prevent resistive currents through the earth between the adjacent cable sections, particularly in the region of the capacitors. The insulation also prevents a resistive current flow between forward and return conductors.

A plurality of tubular electrodes can be connected in parallel. The parallel connection of the capacitors can be advantageously used to increase the capacitance or to increase their dielectric strength.

It is also possible to compensate for the series inductance via largely concentrated transverse capacitances Instead of introducing more or fewer short capacitors into the line as concentrated elements, the capacitance per length unit, which is provided in any case over its entire length by a two-wire line (such as a coaxial line) or a multiwire line, can also be used to compensate for the series inductance. To this end, the inner and outer conductors are interrupted alternately at uniform separating distances, thereby forcing the current flow over the distributed transverse capacitances.

The structural embodiment of the inductor loop can have the configuration of a cable or a solid conductor. The configuration is however of no importance to the electrical functioning described above.

Further information relating to the embodiment of conductors that can also be used for the subject matter of the present invention can be found in DE 10 2004 009 896 A1 and WO 2009/027305 A2.

A frequency generator for controlling the electrical conductor preferably takes the form of a high-frequency generator in the inductor loop. The frequency generator can be constructed as a three-phase unit and advantageously contains a transformer coupling and semiconductor as components. In particular, the circuit can include an inverse rectifier that impresses the voltage. Using such a generator, operation under resonance conditions may be required for proper use to achieve power factor correction. It may be necessary to readjust the control frequency in a suitable manner during operation.

The following components may be present at the surface for the purpose of controlling the conductor of the inductor loop. Taking the three-phase alternating current supply voltage source having a frequency of, e.g., 50 Hz or 60 Hz as a starting point, control is provided for, e.g., a three-phase rectifier, downstream of which is connected, via an intermediate circuit having a capacitor, a three-phase inverse rectifier that generates periodic rectangular signals having a suitable frequency. With a matching network of inductances and capacitors, inductors are controlled as an output. It is, however, possible to dispense with the matching network if the inductor is formed as an inductor loop that allows the required resonant frequency to be set by virtue of its inductance and the capacitance per unit length.

The frequency generators described above are essentially used as power converters that impress a voltage or a current accordingly.

The temperature in the warming zone depends on the electromagnetic power that is introduced, this being dependent on the geological and physical (e.g., electrical conductivity) parameters of the deposit, and on the technical parameters of the electrical arrangement comprising conductors of the inductor loop and the high-frequency generator in particular. This temperature can reach up to 300° C. and can be adjusted by changing the current strength through the inductor loop. This adjustment is effected via the frequency generator. The electrical conductivity of the deposit can be increased by additionally injecting water or another fluid, such as an electrolyte.

For example, control of the conductor of the inductor loop can take place over a time period, where removal of the warmed fluid does not initially occur. The temperature rise initially occurs due to the induction of eddy currents in the electrically conductive regions of the substrate. Temperature gradients, i.e., locations of higher temperature than the original reservoir temperature, arise during the warming process. The locations of higher temperature arise where eddy currents are induced. The source of the warmth is therefore not the inductor loop or the electrical conductor, but the eddy currents that are induced by the electromagnetic field in the electrically conductive layer. As a result of the temperature gradients that are produced over the course of time, and depending on the thermal parameters, such as thermal conductivity, heat conduction also occurs, whereby the temperature profile is equalized. As the distance from the conductor of the inductor loop increases, the strength of the alternating field decreases, such that only reduced warming is possible there.

By contrast, if the fluid or the electrically conductive liquids made fluid are removed as soon as they become fluid, any warming that occurs due to eddy currents in the places which have been extracted will decrease as a function of the quantity of earth, with its electrical conductivity, that is removed. Although the electromagnetic field is still there, eddy currents can only form where conductivity is still present. However, the flowing out of one liquid can cause another liquid to flow in.

The configuration of the electrical arrangement is therefore preferably selected such that the penetration depth of the electromagnetic field typically corresponds to half the separating distance between the horizontally formed inductor arms. It is thus possible to ensure that the electromagnetic fields of forward and return conductors of the conductor do not compensate for each other, and also that the number of bores can remain optimally low relative to the thickness of the reservoir.

If the electrically conductive liquids made fluid are removed immediately, the electromagnetic field reaches electrically conductive layers that are further away from the inductor arm and induces eddy currents there. This has the advantage of being a self-penetrating effect, meaning that the absolute power introduced into the reservoir can be held constant at all times, e.g., in the range of several 100 kW to several megawatts, such as 1 MW. The highest specific power density is initially in the vicinity of the inductor arm, but as soon as the fluids are removed, a lower specific power density, but in a larger volume, is present in the radius that has been extended outwards, and consequently the absolute power introduced remains the same, such as 1 MW.

This cannot be achieved using other electrical methods, for example, in the case of a heating element rod (similar in design to an immersion heater), the power that can be introduced into the surroundings is always dependent on the temperature gradient and the thermal conductivity (which is variable according to the temperature), because the heating element rod is the source of the temperature.

The number of inductor arms that must be installed, where these can be operated concurrently or sequentially, depends on the size of the deposit of the oil reservoir, and the number of inductor arms concurrently in operation depends, e.g., on the electrical power that is available.

When the conductor of the inductor loop is in operation, the crude oil flows into the extraction bore, or into an extraction pipe that is installed therein, by virtue of its reduced viscosity.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

BRIEF DESCRIPTION OF THE DRAWINGS

Further features, advantages and details of the invention are derived from the following description, in which exemplary embodiments of the invention are described in detail with reference to the drawings. In this case, the features cited in the claims and in the description may be essential to the invention either individually or in any desired combination, in which:

DETAILED DESCRIPTION OF THE EXEMPLARY EMBODIMENTS

Figure 1:
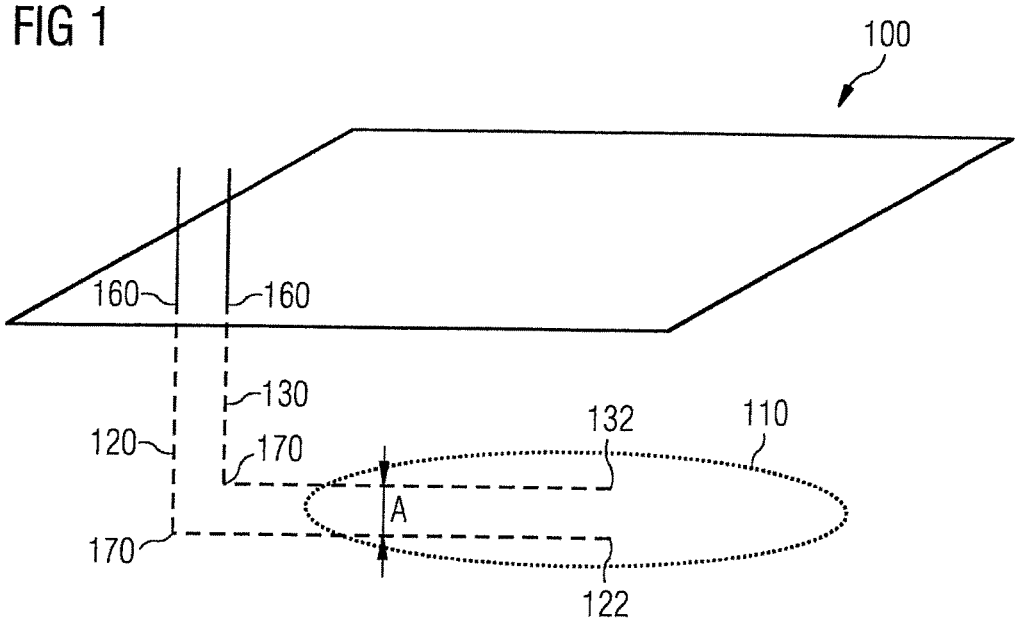
FIG. 1 schematically shows a first step of a method in accordance with the invention.
Figure 2:
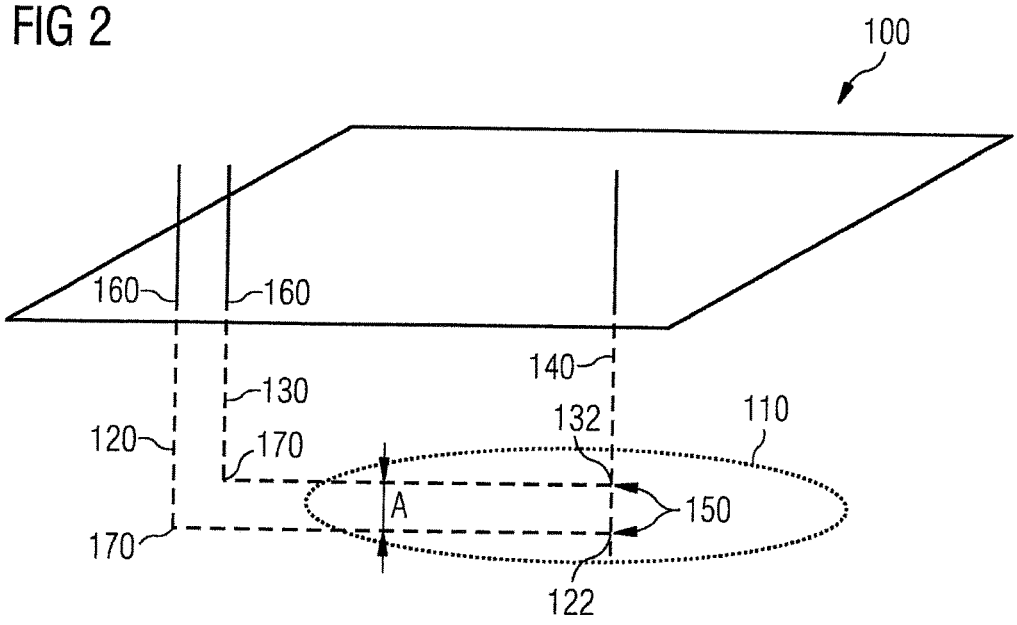
FIG. 2 schematically shows a second step of a method in accordance with the invention.
Figure 3:
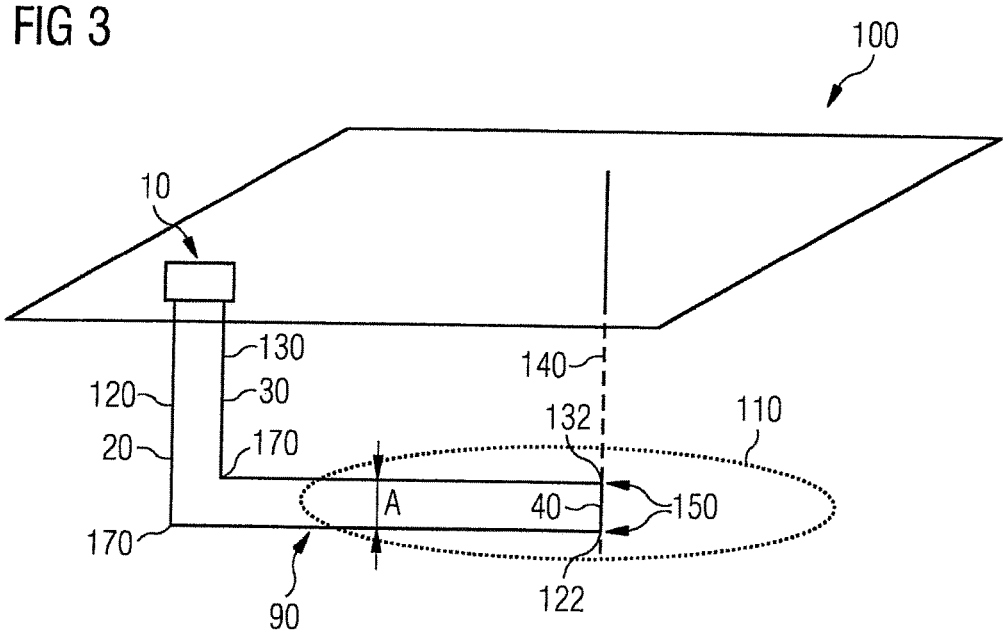
FIG. 3 schematically shows a third step of a method in accordance with the invention.

FIGS. 1 to 3 describe a method in accordance with the invention. Two inductor bores 120 and 130 are introduced separately via two inductor bore openings 160, here. After a first vertical course, the two inductor bores 120 and 130 are redirected via a redirection point 170 into horizontal planes at different heights in the oil reservoir 110 in the rock formation 100. In this case, the two inductor bores 120 and 130 are blind holes, each having a bore end 122 and 132. The separating distance A within the oil reservoir 110 is preferably constant and configured so as to be greater than approximately 50 m.

After drilling the inductor bores 120 and 130, at least one and in this exemplary embodiment exactly one intersecting bore 140 is made. This takes place purely vertically here, because the two inductor bores 120 and 130 are arranged at different heights in a vertically aligned plane. In this case, the intersecting bore 140 creates regions of intersection 150 in the region of the respective bore ends 122 and 132.

After all of the bores 120, 130 and 140 have been created, the two inductor arms 20 and 30 are introduced into the two inductor bores 120 and 130. A connecting arm 40 is now arranged at the respective bore ends 122 and 132, closing the inductor loop 90 and thereby forming the induction device 10. Here, on the surface of the rock formation 100, it is of course also possible to create a control unit that provides the inductor loop 90 with the corresponding injection of current for the heating process.

Figure 4:
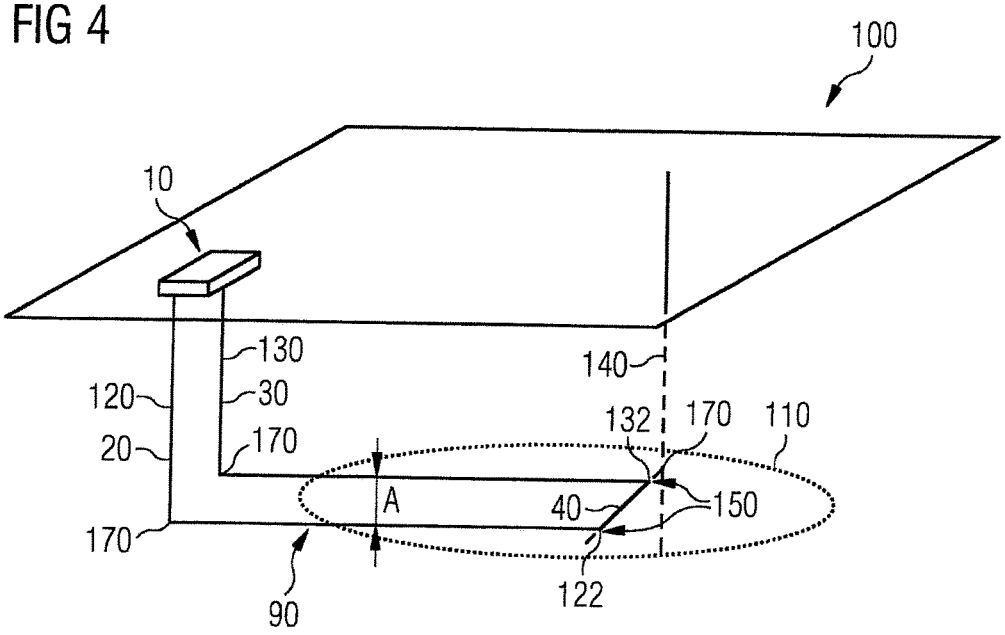
FIG. 4 schematically shows a further embodiment of an induction device in accordance with the invention.

FIG. 4 shows an embodiment that differs from the embodiment shown in FIGS. 1 to 3, in which the two inductor arms 20 and 30 are not at different heights, but extend side-by-side at a separating distance from each other at an identical height within the oil reservoir 110. The intersecting bore 140 must therefore likewise be redirected by a redirection point 170. The other features of this embodiment correspond to the embodiment from FIGS. 1 to 3.

Figure 5:
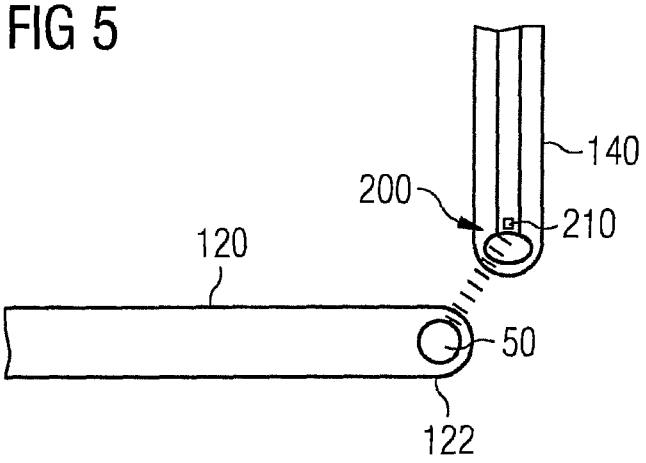
FIG. 5 schematically shows a representation of the action of a locating means in accordance with the invention.
Figure 6:
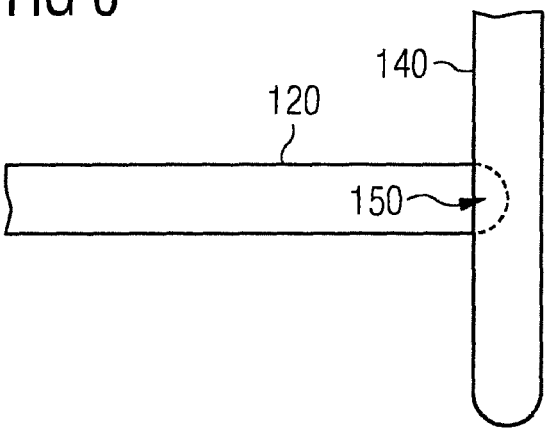
FIG. 6 schematically shows a possibility for a region of intersection in accordance with the invention.

FIG. 5 illustrates the boring process for the intersecting bore 140. In this embodiment, a locating means 50 that provides signals in, e.g., magnetic or radiative form, is situated at the bore end 122 of the first inductor bore 120. The drill head 200, that creates the intersecting bore 140, has a detection device 210 for receiving these signals. By virtue of this "tracer process", it is highly probable that a situation as shown in FIG. 6 can be achieved. Here, the region of intersection 150 between the intersecting bore 140 and the inductor bore 120 is formed as an overlapping region of intersection 150. It is now possible to effect a mechanical contact at this point for the electrically conductive connection between the connecting arm 40 and the respective inductor arm 20 or 30.

Figure 7:
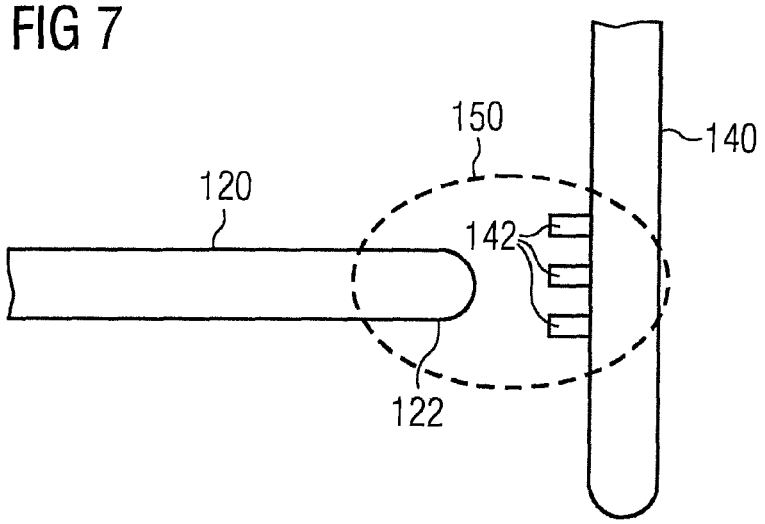
FIG. 7 schematically shows a further possibility for a region of intersection in accordance with the invention.
Figure 8:
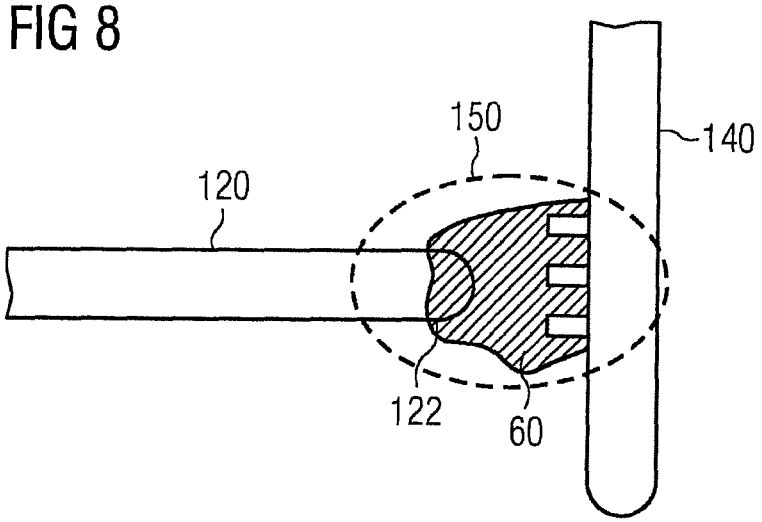
FIG. 8 schematically shows a possibility for the use of an electrically conductive fluid in accordance with the invention.

FIGS. 7 and 8 show a situation which can be achieved, e.g., without a locating means 50. Here, region of intersection 150 is formed as a convergence or minimal separating distance between the intersecting bore 140 and the inductor bore 120. This minimal separating distance is preferably smaller than or equal to approximately 1 m. Consequently, the rock formation 100 itself can therefore form the electrically conductive connection in this region of intersection 150. In order to ensure that the conductivity is not impeded by rock types having poor electrical conductivity, an electrically conductive fluid 60 can be introduced using transverse bores 142, for example. In this case, electrically conductive liquid can be used, particularly in the form of a suspension of electrically conductive particles.

Figure 9:
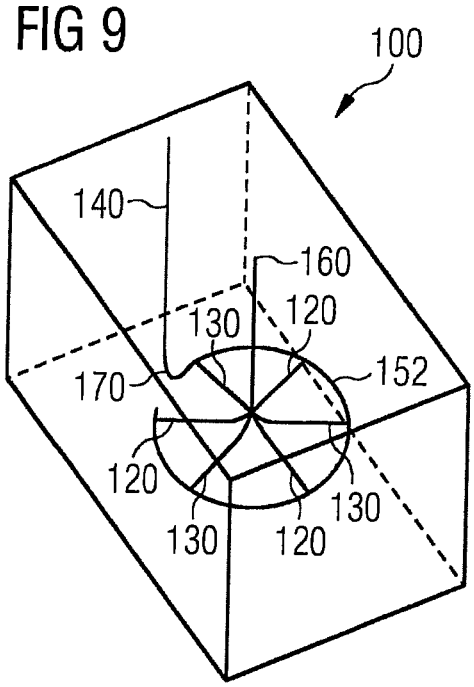
FIG. 9 schematically shows a geometric arrangement of the individual bores in accordance with the invention.
Figure 10:
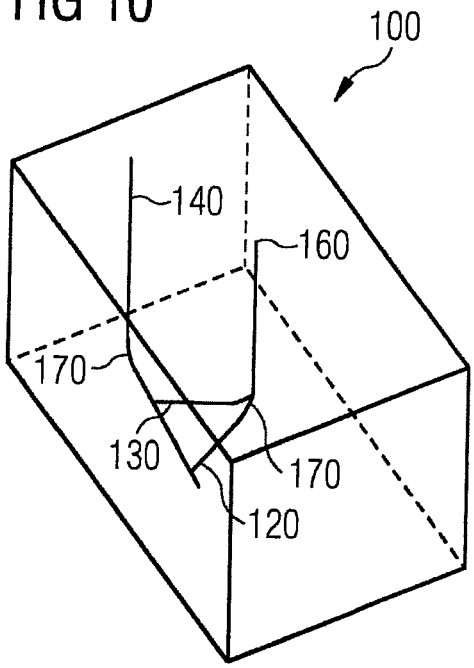
FIG. 10 schematically shows a further possibility for the arrangement of the individual bores in accordance with the invention.

FIGS. 9 to 12 illustrate different geometries for the arrangement of the individual bores 120, 130 and 140. FIG. 9 shows an embodiment having radial distribution of three first inductor arms 120 and three second inductor arms 130 in total. In order to connect the respective arms 120 and 130 to form a respective inductor loop 90, provision is made here for an intersecting bore 140 that follows a circular path 152 after the redirection point 170. FIG. 10 illustrates an embodiment in which two inductor arms 120 and 130 spread apart after the redirection point 170. In a similar manner to that shown in FIG. 4, distribution on a shared horizontal plane is possible in this type of configuration. Here, though, a shared inductor bore opening 160 has been used, as in the case of FIGS. 9 and 11, such that the inductor arms 120 and 130 run through a shared bore in the vertical section.

Returning to FIG. 9, the circular path 152 meets all of the ends of the plurality of inductor arms 120 and 130. However, provision is preferably made for inserting a plurality of connecting arms into the circular path, such that only two adjacent arms of inductor arms 120 and 130 are connected together in each case. The remaining sections of the circular path 152 do not contain any conductive sections. A respective connecting arm is therefore only a segment of a circle, specifically, e.g., a segment of a circle having an angle of approximately 60° in the example according to FIG. 9. Provision is preferably made for three conductive sections to be arranged in the circular path 152 in the example of FIG. 9. Between the conductive sections, the bore of the circular path 152 may remain empty or be filled by a nonconductive section.

Figure 11:
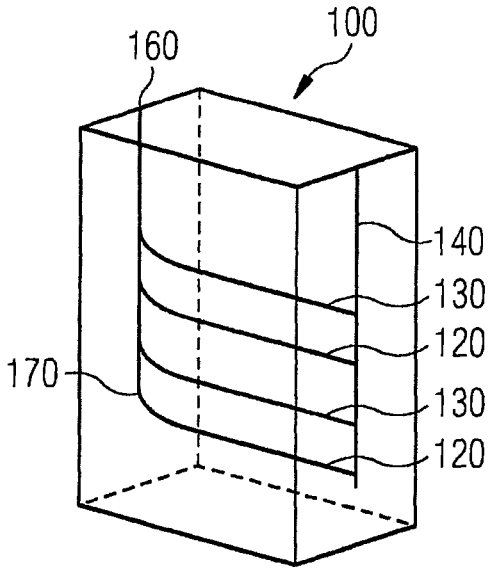
FIG. 11 schematically shows a further possibility for the arrangement of the individual bores in accordance with the invention.

FIG. 11 shows an embodiment in which the inductor arms 120 and 130 are distributed via redirection points 170 over different heights within the rock formation 100. Here, a shared inductor bore opening 160 can be used again. It is even sufficient here to make a single vertical bore as an intersecting bore 140. In the case of particularly far-reaching oil reservoirs 110, it is also possible to use an embodiment as per FIG. 12, which has a dedicated inductor bore opening 160 for each inductor bore 120 and 130, wherein a shared intersecting bore 140 provides the desired connection for the electrical conductivity that is required to close the inductor loops 90.

Figure 12:
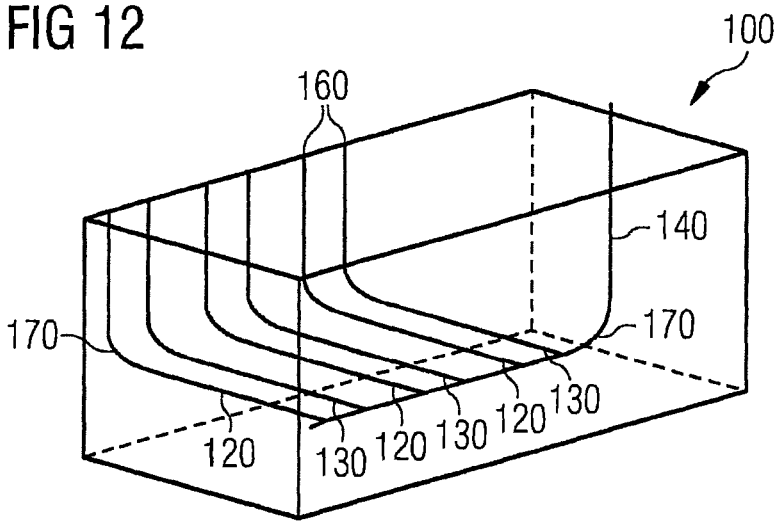
FIG. 12 schematically shows a further possibility for the arrangement of the individual bores in accordance with the invention.

With regard to FIGS. 11 and 12, it should be noted that two adjacent inductor arms 120 and 130 are each conductively connected together. To this end, it is preferably possible to introduce a plurality of connecting arms into the intersecting bore 140, such that only two adjacent arms of inductor arms 120 and 130 are connected together in each case. The remaining sections of the intersecting bore 140 contain no conductive sections. A respective connecting arm is therefore merely a tubular conductor of limited length. According to the example in FIG. 11, two conductive sections are arranged in the intersecting bore 140. In FIG. 12, three conductive sections are arranged in the intersecting bore 140, each between a pair of two inductor arms 120, 130. Between the conductive sections, the bore of the intersecting bore 140 may remain empty or be filled by a nonconductive section.

In particular, the disclosed embodiments of invention have the advantage of making it easy to close a conductor loop that can be operated by a frequency converter during operation. The inductor arms 120, 130 in this case have means which, during operation, generate an electromagnetic field that extends into the oil reservoir and then acts inductively on the oil or on hydrocarbons in the oil reservoir. The electrically closed part of the conductor loop, which consists of the electrically conductive connecting arm in the intersecting bore, does not necessarily include means which generate a distinctive electromagnetic field in a particular manner. Indeed, this is unnecessary because the connecting arm is essentially provided for the purpose of completing the conductor loop. This results in a contiguous conductor loop consisting of two inductor arms 120, 130 and the connecting arm for connecting these two inductor arms 120, 130.

The foregoing explanation of the embodiments describes the present invention solely in the context of examples. It is naturally possible freely to combine individual features of the embodiments, where technically applicable, without thereby departing from the scope of the present invention.

Figure 13:
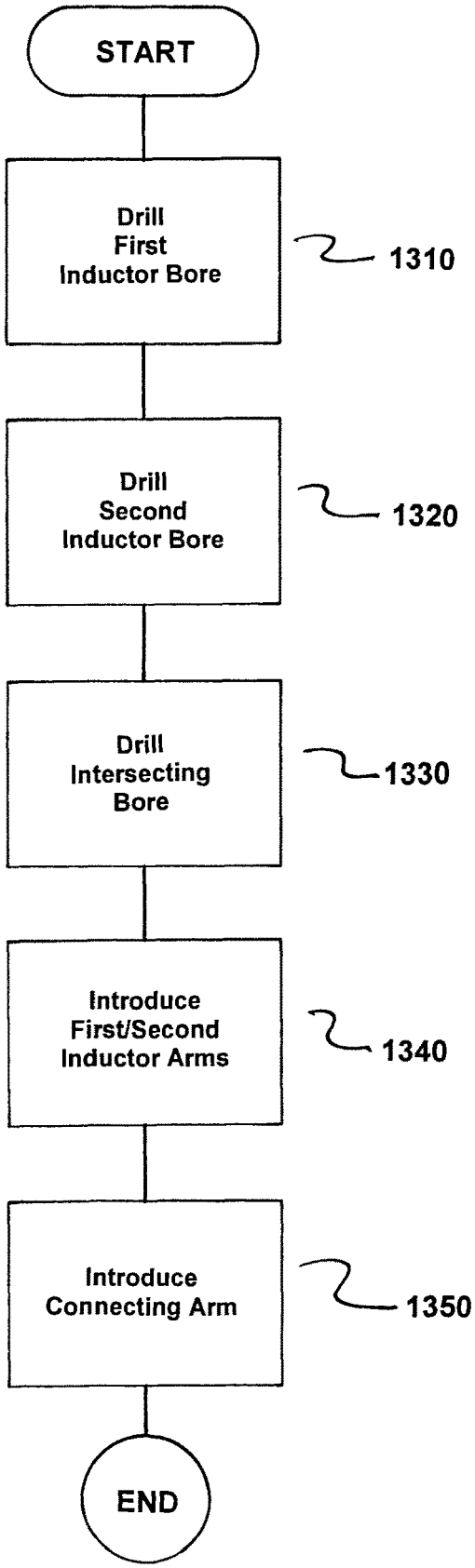
FIG. 13 is a flowchart of the method in accordance with the invention.

FIG. 13 is a flowchart of a method for introducing an inductor loop (90) into a rock formation (100) to heat an oil reservoir (110) in the rock formation (100) to extract oil. The method comprises drilling a first inductor bore (120) for introducing a first inductor arm (20), as indicated in step 1310.

Next, a second inductor bore (130) is drilled for introducing a second inductor arm (30), as indicated in step 1320.

At least one intersecting bore (140) is now drilled to create a first region of intersection (150) with the first inductor bore (120) and a second region of intersection (150) with the second inductor bore (130), as indicated in step 1330.

Next, the first inductor arm (20) is introduced into the first inductor bore (120) and the second inductor arm (30) into the second inductor bore (130), as indicated in step 1340.

Next, at least one connecting arm (40) is introduced into the intersecting bore (140) for electrically conductive connection to the two inductor arms (20, 30) in the two regions of intersection (150) so as to form the inductor loop (90), as indicated in step 1350.

Thus, while there have been shown, described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

The invention claimed is:

1. A method for introducing an inductor loop into a rock formation to heat an oil reservoir in the rock formation to extract oil, the method comprising:

drilling a first inductor bore for introducing a first inductor arm;

drilling a second inductor bore for introducing a second inductor arm;

drilling at least one intersecting bore to create a first region of intersection with the first inductor bore and a second region of intersection with the second inductor bore;

introducing the first inductor arm into the first inductor bore and the second inductor arm into the second inductor bore;

introducing at least one connecting arm into the intersecting bore for electrically conductive connection to the first and second inductor arms in the first and second regions of intersection so as to form the inductor loop; and introducing an electrically conductive fluid into at least one of the first and second regions of intersection via the at least one intersecting bore to create the electrically conductive connection of the at least one connecting arm and a respective adjacent inductor arm of the first and second inductor arms.

2. The method as claimed in claim 1, wherein the first inductor bore and the second inductor bore are drilled through a shared inductor bore opening.

3. The method as claimed in claim 1, wherein the first and second inductor bores have at least one redirection point.

4. The method as claimed in claim 1, wherein the intersecting bore has at least one redirection point.

5. The method as claimed in claim 1, wherein a locator is arranged at a bore end of at least one of the first and second inductor bores to detect said bore end when drilling the intersecting bore.

6. The method as claimed in claim 1, wherein the intersecting bore is closed off.

7. The method as claimed in claim 1, wherein the first and second inductor bores within the oil reservoir are drilled at uniform or essentially uniform separating distances of more than approximately 50 m.

8. The method as claimed in claim 1, further comprising:

introducing at least one transverse bore, via the at least one intersecting bore, into the first and second regions of intersection of the at least one intersecting bore to introduce the electrically conductive fluid.

9. The method as claimed in claim 3, wherein the first and second inductor bores have one redirection point.

10. The method as claimed in claim 4, wherein the at least one redirection point is drilled sectionally along a curved path.

11. The method as claimed in claim 6, wherein the intersecting bore is filled in adjacent to the at least one connecting arm to close off said at least one intersecting bore.

12. An induction device for heating an oil reservoir in a rock formation to extract oil, comprising:

a first inductor arm in a first inductor bore;

a second inductor arm in a second inductor bore; and at least one connecting arm arranged in an intersecting bore which forms a first region of intersection with the first inductor bore and a second region of intersection with the second inductor bore;

wherein the at least one connecting arm connects the first and second inductor arms together in an electrically conductive manner so as to form an inductor loop; and wherein an electrically conductive fluid is introduced into at least one of the first and second regions of intersection via the intersecting bore to create an electrically conductive connection of the at least one connecting arm and a respective adjacent inductor arm of the first and second inductor arms.

* * * * *